US010636643B2

(12) United States Patent
Oka et al.

(10) Patent No.: US 10,636,643 B2
(45) Date of Patent: Apr. 28, 2020

(54) IONIZATION METHOD SELECTION ASSISTING APPARATUS AND METHOD

(71) Applicant: JEOL Ltd., Tokyo (JP)

(72) Inventors: Kazuko Oka, Tokyo (JP); Haruo Iwabuchi, Tokyo (JP); Takaya Sato, Tokyo (JP)

(73) Assignee: JEOL Ltd., Tokyo (JP)

( * ) Notice: Subject to any disclaimer, the term of this patent is extended or adjusted under 35 U.S.C. 154(b) by 69 days.

(21) Appl. No.: 15/895,276

(22) Filed: Feb. 13, 2018

(65) Prior Publication Data

US 2018/0233344 A1 Aug. 16, 2018

(30) Foreign Application Priority Data

Feb. 14, 2017 (JP) ..... 2017-024640

(51) Int. Cl.
*H01J 49/10* (2006.01)
*H01J 49/26* (2006.01)
*H01J 49/00* (2006.01)

(52) U.S. Cl.
CPC ..... *H01J 49/107* (2013.01); *H01J 49/0031* (2013.01)

(58) Field of Classification Search
CPC ..... H01J 49/107; H01J 49/0031; G01N 27/62
See application file for complete search history.

(56) References Cited

U.S. PATENT DOCUMENTS 5,668,370 A * 9/1997 Yano ..... H01J 49/107 250/285
2004/0121969 A1* 6/2004 Hendricks ..... C07H 19/056 514/43

FOREIGN PATENT DOCUMENTS

JP 95300 A 1/1997
JP 2014215078 A 11/2014

OTHER PUBLICATIONS

Badu-Tawiah et al. 'Non-Aqueous Spray Solvents and Solubility Effects in Desorption Electrospray Ionization' Jan. 4, 2010, J Am Soc Mass Spectrom, V 21, p. 572-579 (Year: 2010).*
JEOL, 'DART Direct Analysis in Real Time' May 4, 2015 wayback machine capture, JEOL product information website (Year: 2015).*

* cited by examiner

*Primary Examiner* — Eliza W Osenbaugh-Stewart
(74) *Attorney, Agent, or Firm* — The Webb Law Firm

(57) ABSTRACT

An ionization method selection assisting image includes a coefficient axis indicating the magnitude of a partition coefficient, a plurality of method indicators representing a plurality of coefficients or a plurality of coefficient ranges corresponding to a plurality of ionization methods, and a sample marker representing the partition coefficient specified for a sample. The ionization method selection assisting image is displayed to a user. A partition coefficient may be specified for a sample after derivatization.

9 Claims, 11 Drawing Sheets

| NAME OF COM-POUND | COMPO-SITION FORMU-LA | STRUC-TURE | ... | EXACT MASS | ... | PARTITION COEFFICIENT (LogP) | | | | |
|---|---|---|---|---|---|---|---|---|---|---|
| | | | | | | WITHOUT DERIVATIZATION | METHYLATION (CORRECTION VALUE) | TMS DERIVATIZATION (CORRECTION VALUE) | ACETYLATION (CORRECTION VALUE) | ... |
| *** | *** | *** | | *** | | **** | **** | **** | | |
| *** | *** | *** | | *** | | **** | | | **** | |
| . . . | . . . | . . . | | . . . | | . . . | . . . | . . . | . . . | |

32 34 36

48

| NAME OF COMPOUND | COMPOSITION FORMULA | STRUCTURE | ... | EXACT MASS | ... | PARTITION COEFFICIENT (LogP) | | | |
|---|---|---|---|---|---|---|---|---|---|
| | | | | | | WITHOUT DERIVATIZATION | METHYLATION | TMS DERIVATIZATION | ACETYLATION | ... |
| *** | *** | *** | | *** | | **** | **** | **** | | |
| *** | *** | *** | | *** | | **** | | | **** | |
| ... | ... | ... | | ... | | ... | ... | ... | ... | |

50

56

| NAME OF COM-POUND | COMPOSI-TION FORMULA | STRUC-TURE | ... | FUNCTIONAL GROUP INFORMATION | ... | (WITHOUT DERIVATIZATION) PARTITION COEFFICIENT (LogP) |
|---|---|---|---|---|---|---|
| *** | *** | *** | | *** | | **** |
| *** | *** | *** | | *** | | **** |
| ... | ... | ... | | ... | | ... |

IONIZATION METHOD SELECTION ASSISTING APPARATUS AND METHOD

CROSS REFERENCE TO RELATED APPLICATION

The disclosure of Japanese Patent Application No. 2017-024640 filed on Feb. 14, 2017 including the specification, claims, drawings, and abstract is incorporated herein by reference in its entirety.

TECHNICAL FIELD

The present disclosure relates to an apparatus and a method for assisting ionization method selection, and more particularly to an apparatus for assisting selection of an ionization method in mass spectroscopy.

BACKGROUND

Mass spectroscopy for samples, such as organic compounds, uses mass spectrometers. A mass spectrometer typically includes an ion source, a mass spectrometry unit, and a data processing unit, for example. The mass spectrometry unit uses an electric field and/or a magnetic field to separate or extract individual ions in accordance with m/z of the individual ions: where m is mass of the ion and z is electric charge. The data processing unit generates a mass spectrum based on the detection results by the mass spectrometry unit. Known mass spectroscopy methods include time-of-flight mass spectroscopy, quadrupole mass spectroscopy, double focusing mass spectroscopy, ion trap mass spectroscopy, and ion cyclotron mass spectroscopy, for example.

The ion source ionizes a sample. Known ionization methods include Electron Ionization (EI), Chemical Ionization (CI), Atmospheric Pressure Chemical Ionization (APCI), and Electro Spray Ionization (ESI), for example.

Direct Analysis in Real Time (DART) has been widely used. DART generates plasma from helium gas using corona discharge, for example, and extracts neutral gas molecules in an excited state out of the plasma and irradiates a sample with the neutral gas molecules to produce a positive ion or a negative ion of the sample. (See JP 2014-215078 A, for example). DART, which is one type of APCI and can be used to analyze various ambient substances without pretreatments, is regarded as one ambient analysis technology.

When a gas chromatography apparatus or a liquid chromatography apparatus, for example, is connected to a mass spectrometer, an ion source in accordance with the ionization method including EI, ESI, or APCI described above is used as an interface.

As there are no ionization methods that are adaptable to all substances, a user needs to select an ionization method in accordance with a sample. Specifically, to perform mass spectroscopy with high precision, an appropriate ionization method which is suitable for a sample substance must be selected. It is known, for example, that ESI is not typically suitable for substances with low polarity, and that EI and APCI are not typically suitable for substances with high polarity and thermally unstable substances. While DART is known to be suitable for a relatively wide range of polarity, it is difficult to definitely specify the upper or lower limit of polarity.

SUMMARY

Technical Problem

A diagram that maps a plurality of ionization methods on two-dimensional coordinates is known as a reference used in selecting among ionization methods. More specifically, such a diagram has a horizontal axis indicating the magnitude of polarity and a vertical axis indicating the magnitude of molecular weight. A plane defined by these axes includes figures each representing a roughly defined range to which each ionization method is adapted. Typically, deviation of electric charge in molecules, for example, is expressed as a polarity. However, correct definition for a polarity has not been established.

The polarity is typically a physical property that is ambiguous or difficult to represent numerically. Even if a polarity can be numerically represented in a certain manner, many substances involve difficulty in obtaining objective numeral values. In particular, it is difficult for a user having poor knowledge or poor experience concerning mass spectroscopy to determine an ionization method suitable for a sample which is a subject of analysis only from the diagram as described above.

JP H09-5300 A discloses a liquid chromatography mass spectrometry apparatus having a database which associates compound categories with control conditions. This apparatus automatically specifies and sets control conditions, including an ionization method, suitable for the compound category designated by a user. This apparatus, however, fails to provide information that enables the user to intuitively recognize adaptability or compatibility between the designated compound and each ionization method.

Embodiments of the disclosure are therefore directed toward assisting selection of an ionization method by a user in mass spectroscopy. Alternatively, embodiments of the disclosure are directed at selecting an ionization method based on an objective physical property which can be easily represented numerically or providing a user with visual information that allows intuitive recognition of a correlation between a sample and a plurality of ionization methods, particularly compatibility between a sample and a plurality of ionization methods. Alternatively, embodiments of the disclosure are directed toward providing a user with information that helps the user determine the necessity of derivatization or an optimal derivatization type, for example. Alternatively, embodiments of the disclosure are directed toward assisting selection of an ionization method for a compound which cannot be identified.

Solution to Problem

In one aspect of the disclosure, an ionization method selection assisting apparatus includes a specifying unit configured to specify a coefficient representing a degree of water solubility of a sample that is a subject of mass spectroscopy, and a generating unit configured to generate an ionization method selection assisting image including a coefficient axis associated with a plurality of ionization methods and a sample marker indicating the coefficient.

The above structure specifies, as a physical property of a sample that is a subject of mass spectroscopy, a coefficient indicating the degree of water solubility; in other words, hydrophilicity, hydrophobicity, or liposolubility, and, based on the coefficient, generates an ionization method selection assisting image. The ionization method selection assisting image includes a coefficient axis indicating the magnitude of the coefficient and a sample marker indicating the coefficient specified for the sample. A plurality of ionization methods are associated with the coefficient axis. Specifically, the ionization method selection assisting image is configured to allow visual recognition of the coefficient or coordinates, or the coefficient range or coordinate range, corresponding to each ionization method on the coefficient axis. Thus, referencing the indicated position or indicated coordinates, of the sample marker on the coefficient axis enables intuitive recognition of compatibility between the sample and the individual ionization methods. Even an ionization method selection assisting image that shows only rough compatibility, rather than precise compatibility, provides more benefits to users than the case where no assisting information is provided. When attempting to use a plurality of selectable ionization methods one by one, for example, the priority order may be determined based on the content of the ionization method selection assisting image.

The above coefficient indicates the degree of water solubility, and is typically octanol/water partition coefficient represented as Log P or Log D. Other coefficients indicating the degree of water solubility or the degree of liposolubility may also be used. The partition coefficient can be measured objectively. The partition coefficients for typical substances are specified. The coefficient can also be determined by calculation based on the composition and structure of a substance. There is a general trend that ESI is not suitable for compounds with low water solubility or high liposolubility and that EI is not suitable for compounds with high water solubility. There is also an acknowledged trend that DART is suitable for compounds with low water solubility through compounds with high water solubility. Therefore, the use of the partition coefficient or equivalent coefficients as a criterion for selecting an ionization method is practical.

In an embodiment, the ionization method selection assisting image includes a plurality of method indicators corresponding to the plurality of ionization methods, each of the method indicators is associated with coordinates or a coordinate range on the coefficient axis, and a positional relationship between the sample marker and each of the method indicators represents compatibility between the sample and each of the ionization methods. Each method indicator may include a character, a character string, a symbol, a figure, and other display elements. The sample marker may similarly include a character, a character string, a symbol, a figure, and other display elements. The sample marker functions as a display element indicating specific coordinates or specific coordinate range on the coefficient axis.

In an embodiment, the specifying unit has a function to specify the coefficient when the sample is not derivatized and a function to specify the coefficient when the sample is derivatized. This structure enables specification of a correction coefficient for a sample which is either not derivatized (and cannot be derivatized) or is derivatized. The specifying unit is configured to determine a correction coefficient, concerning a sample compound which can be derivatized with a plurality of types of derivatization methods, for each derivatization type or each derivatization reagent.

In an embodiment, the specifying unit includes a database including a plurality of records corresponding to a plurality of compounds that are possible samples and a search unit configured to search the database to specify the coefficient, and a record for a compound that can be derivatized includes a coefficient before derivatization and information for specifying a coefficient after derivatization.

Some example structures are possible for the specifying unit. In the first example structure, a record for a compound that can be derivatized includes a coefficient before derivatization and a correction value for determining a coefficient after derivatization from the coefficient before derivatization, and the specifying unit includes a correction unit configured to correct the coefficient before derivatization using the correction value to calculate the coefficient after derivatization. In the second example structure, a record for a compound that can be derivatized includes a coefficient before derivatization and a coefficient after derivatization. In the third example structure, a record for a compound that can be derivatized includes a coefficient before derivatization and functional group information, and the specifying unit includes a correction unit configured to correct the coefficient before derivatization using a correction value based on the functional group information to calculate a coefficient after derivatization. Each record in the database includes at least one of the name of a compound, the composition formula, the structure, or exact mass.

In an embodiment, the ionization method selection assisting image includes a first axis serving as the coefficient axis and a second axis orthogonal to the first axis. The second axis represents a physical property other than the coefficient. The sample marker is displayed at a position in accordance with coordinates on the first axis corresponding to the coefficient and coordinates on the second axis corresponding to the physical property of the sample other than the coefficient.

In another aspect of the disclosure, an ionization method selection assisting method includes the steps of specifying a partition coefficient of a sample that is a subject of mass spectroscopy, generating ionization method selection assisting information based on the partition coefficient, and displaying the ionization method selection assisting information. The ionization method selection assisting information enables a user to recognize one or more ionization methods suitable for the sample.

Various available ionization methods include, for example, ionization methods suitable for water soluble samples, ionization methods suitable for liposoluble samples, and ionization methods suitable for both water soluble samples and liposoluble samples. As the partition coefficient is a physical property indicating the degree of water solubility or liposolubility, evaluating the compatibility between a sample and each ionization method based on the partition coefficient is acknowledged to be reasonable. The above structure, under such understanding, specifies the partition coefficient of a sample, and, based on the partition coefficient, generates and provides to a user ionization method selection assisting information. In preferred embodiments, an ionization method selection assisting image is provided as the ionization method selection assisting information. In place of such an image, one or more ionization methods that may be suitable for the sample may be displayed as text information. Compatibility of each ionization method with the sample may be displayed in numerical values.

In preferred embodiments, the above ionization method selection assisting method is implemented as a function of a program, and the program is installed in an information processor via a storage medium or via the network.

BRIEF DESCRIPTION OF DRAWINGS

Embodiments of the present disclosure will be described by reference to the following figures, wherein.

DESCRIPTION OF EMBODIMENTS

Embodiments of the present disclosure will be described with reference to the drawings.

Figure 1:
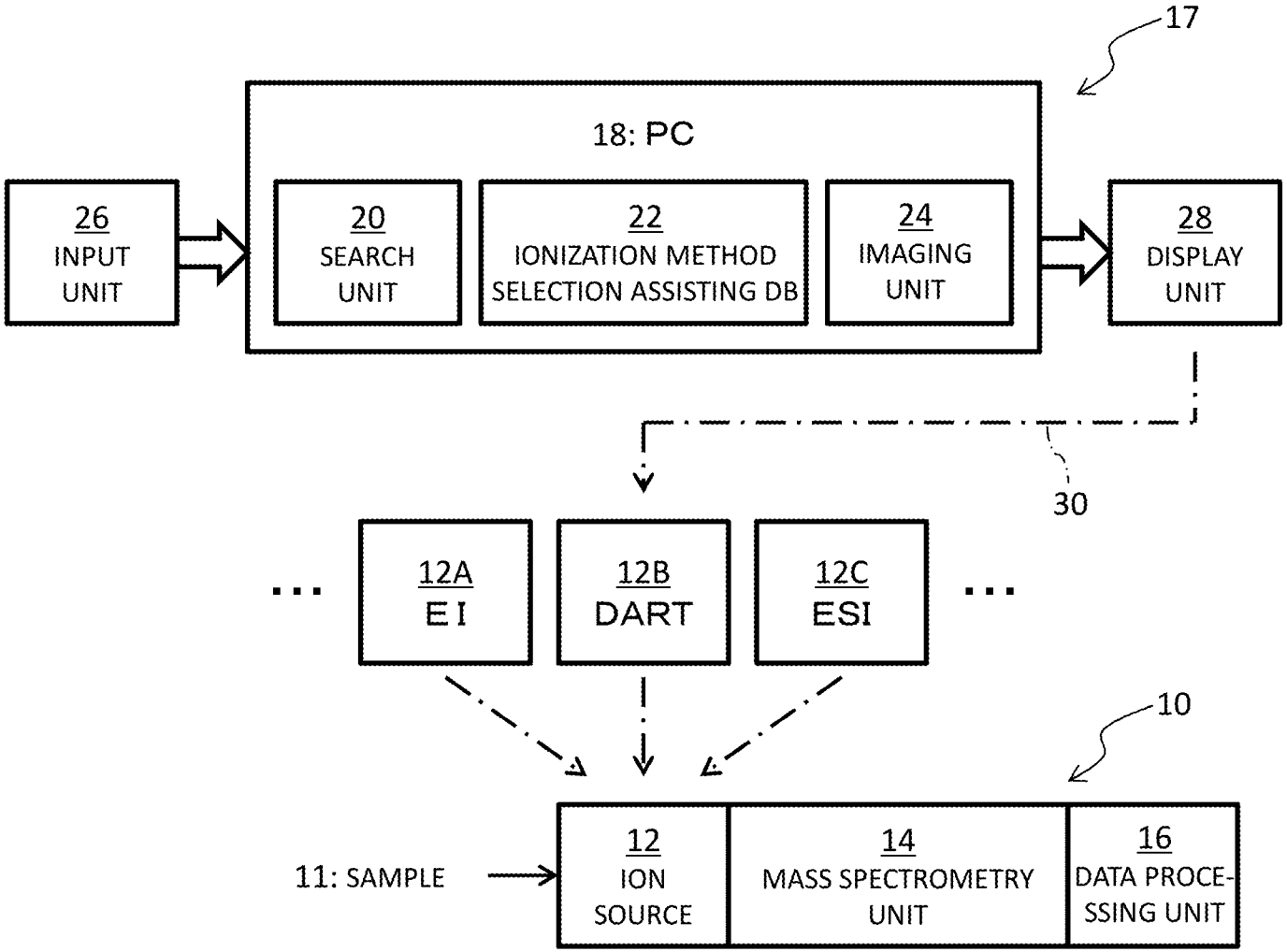
FIG. 1 is a diagram illustrating an example structure of a mass spectrometer system according to an embodiment of the present disclosure.

FIG. 1 illustrates a mass spectrometer system. The mass spectrometer system includes an ionization method selection assisting apparatus 17 and a mass spectrometer 10. FIG. 1 illustrates the structure of the ionization method selection assisting apparatus 17 in the upper section, illustrates a plurality of types of ion sources 12A, 12B, and 12C in the middle section, and illustrates the structure of the mass spectrometer 10 in the lower section. Based on an ionization method selection assisting image displayed on the ionization method selection assisting apparatus 17, a user selects an ion source suitable for a sample, which is a subject of mass spectroscopy, from among the ion sources 12A, 12B, and 12C, for use in the mass spectroscopy of the sample. Thus, the selected ion source is incorporated in the mass spectrometer 10. The ionization method selection assisting apparatus 17 may be configured as a part of the mass spectrometer 10. In this case, a data processing unit 16 and a PC 18 may be integrally configured.

The mass spectrometer 10, in the illustrated example structure, includes an ion source 12, a mass spectrometry unit 14, and the data processing unit 16. The ion source 12 ionizes a sample 11, which is a compound in this example. The sample may be either a known compound or an unknown compound. The ion source selected by the user from among the ion sources 12A, 12B, and 12C as described above is used as the ion source 12 in the mass spectrometer 10. The ion sources 12A, 12B, and 12C may be used one by one in the order determined by the user.

In this embodiment, the ion source 12A is an ion source based on Electron Ionization (EI), the ion source 12B is based on Direct Analysis in Real Time (DART), and the ion source 12C is based on Electro Spray Ionization (ESI). These ion sources are only examples and other ion sources may be selected. A gas chromatography apparatus or a liquid chromatography apparatus may be connected before the ion source 12.

The mass spectrometry unit 14 separates or extracts individual ions using one or both of an electric field and a magnetic field in accordance with m/z of each ion. Known mass spectroscopy methods include time-of-flight mass spectroscopy, quadrupole mass spectroscopy, double focusing mass spectroscopy, ion trap mass spectroscopy, ion cyclotron mass spectroscopy, and other spectroscopy methods. Other methods may also be used. The data processing unit 16 generates a mass spectrum based on data detected by the mass spectrometry unit 14.

The ionization method selection assisting apparatus 17 will now be described. The ionization method selection assisting apparatus 17 includes the PC 18 serving as an information processor, an input unit 26, and a display unit 28. The PC 18 includes a search unit 20, an ionization method selection assisting database (DB) 22, and an imaging unit 24. The DB 22 is constructed on a storage unit of the PC 18 and includes a plurality of records corresponding to a plurality of compounds that are possible samples. Each record includes a partition coefficient of a compound. Specifically, each record includes at least a partition coefficient before derivatization, including a case where derivatization cannot be performed, as will be described below. A record corresponding to a compound that can be derivatized includes information for identifying a partition coefficient before derivatization and a partition coefficient after derivatization. A plurality of ionization method selection assisting apparatuses serving as a plurality of clients may share a DB which is constructed on a network server.

The search unit 20 functions as a searching unit, a specifying unit, and a correcting unit. The search unit 20 is essentially software (program) executed on a CPU. The search unit 20 specifies a compound to be analyzed, based on one or more information items or compound identifying information items used for specifying a compound that is input by a user, and then specifies a partition coefficient of the compound. The imaging unit 24 functions as a generating unit. The imaging unit 24 is also essentially software executed on a CPU, and generates an ionization method selection assisting image. A GPU or another processor may be used in place of the CPU. Part or all of the search unit 20, the ionization method selection assisting DB, and the imaging unit 24 may be provided as cloud service via the network.

As will be described below, the ionization method selection assisting image includes a coefficient axis indicating the magnitude and also polarity of plus or minus of partition coefficients, a plurality of method indicators indicating a plurality of ionization methods, and a sample marker indicating the partition coefficient specified for a sample. The respective method indicators are associated with coordinates or coordinate ranges on the coefficient axis; the positional relationship between the sample marker and each method indicator on the coefficient axis provides visual recognition of compatibility between the sample and each ionization method.

The partition coefficient, which is an octanol/water partition coefficient, is represented as Log P or Log D. The partition coefficient represents the degree of water solubility, hydrophilicity, hydrophobicity, or liposolubility. The partition coefficient is an objective coefficient, and partition coefficients for typical substances are publicly disclosed. It is considered that the partition coefficient can be determined by calculation based on the composition or structure of a substance. There is a typical trend that ESI is not suitable for compounds with low water solubility or high liposolubility, EI is not suitable for compounds with high water solubility, and DART is suitable for both compounds with low water solubility and compounds with high water solubility. The use of the partition coefficient indicating the degree of water solubility and also the degree of liposolubility, as a criterion for selecting an ionization method, is considered to be reasonable. In place of specification of the partition coefficient using the DB 22, the partition coefficient may be calculated from the composition or structure of a compound. Alternatively, the partition coefficient of a sample compound may be specified by search on the network system. In embodiments, when temperature dependence of a partition coefficient cannot be disregarded, the partition coefficient at a predetermined temperature is registered in the DB or each partition coefficient registered on the DB may be corrected so as to compensate for the temperature dependence.

The ionization method selection assisting image generated by the imaging unit 24 is displayed, as a part of a display image, on a screen of the display unit 28. The display unit 28 is formed of an LCD or an organic EL display unit, for example, and functions as a display means. The input unit 26 includes a key board and a pointing device, for example. For searching, the input unit 26 is used to input compound identifying information. Numeral reference 30 in FIG. 1 indicates user selection of the ion source based on the ionization method selection assisting image. As described above, the PC 18 and the data processing unit 16 may be integrally configured. A program for executing an ionization method selection assisting method may be installed in the PC 18 via a storage medium or the network.

Figure 2:
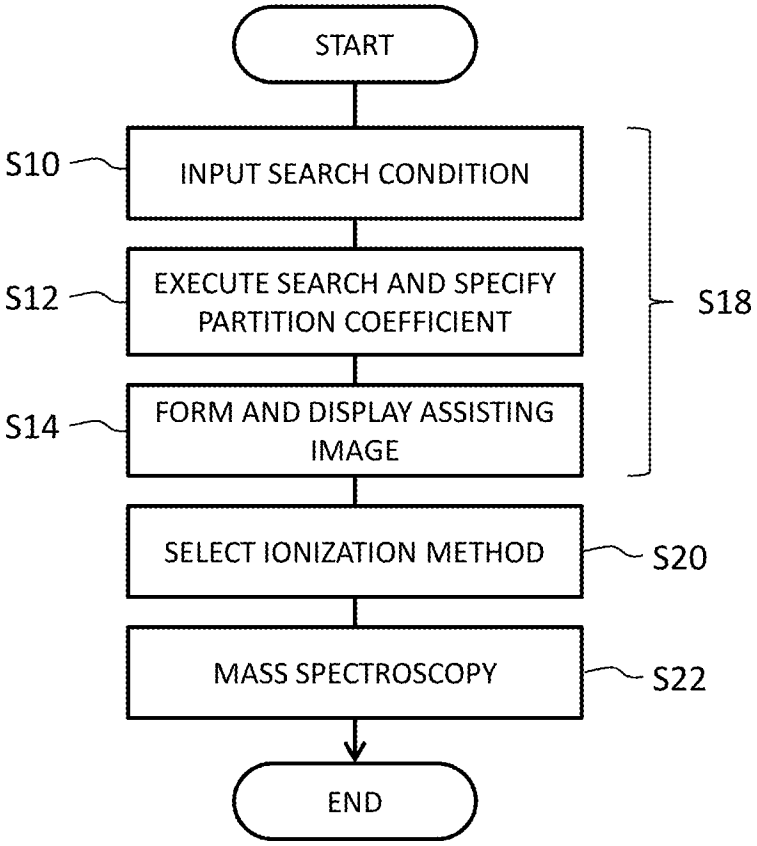
FIG. 2 is a diagram illustrating an example operation of the mass spectrometer system illustrated in FIG. 1.

FIG. 2 is a flow chart showing a mass spectroscopic process including a plurality of steps corresponding to an ionization method selection assisting method. In step S10, a user inputs one or more compound identifying information items concerning a sample, or a compound, that is a subject of mass spectroscopy. The input information constitutes a search condition. In step S12, a DB is searched based on the search condition and the partition coefficient of the sample is specified. In step S14, an ionization method selection assisting image is generated based on the specified partition coefficient and displayed. Steps S10 through S14 correspond to the ionization method selection assisting method or an operation of the ionization method selection assisting apparatus.

In step S20, the user selects one ionization method; that is, one ion source, based on the ionization method selection assisting image. The user may select a plurality of ion sources one by one. In step S22, a mass spectrometer including the selected ion source is used to execute mass spectroscopy concerning the sample, and thus the mass spectrum is observed.

Figures 3, 4:
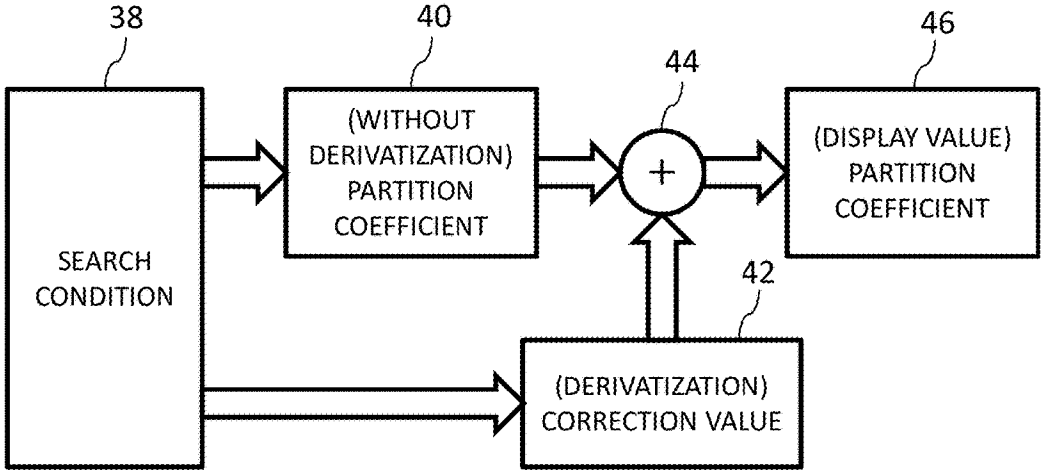
FIG. 3 is a diagram illustrating a first example ionization method selection assisting database.
FIG. 4 is a diagram illustrating a first example method of determining a partition coefficient after derivatization.

FIG. 3 shows a first example ionization method selection assisting DB. The DB includes a plurality of records 32 corresponding to a plurality of compounds that are possible subjects of spectroscopy. Each record 32 includes, as compound identifying information, the name of a compound, a composition formula, a structure, and an exact mass, for example. Each record 32 further includes a partition coefficient without derivatization or a partition coefficient before derivatization (see reference numeral 34), and correction values (see reference numeral 36) for determining a partition coefficient with derivatization or partition coefficient after derivatization. The correction value has a positive or negative sign.

Types of derivatization include methylation (methyl derivatization), trimethylsilylation (TMS derivatization), and acetylation (acetyl derivatization), for example. A derivatization reagent is used for derivatization. For a compound having an OH group or COOH group, for example, it is believed that methylation increases its partition coefficient (Log P) by about +0.1 to +0.7, trimethylsilylation increases its partition coefficient by +1.0 to +1.5, and acetylation increases its partition coefficient by about +0.2. For a compound having an $NH_2$ group (e.g., aniline), it is believed that methylation hardly changes or decreases its partition coefficient by about −0.05, trimethylsilylation increases its partition coefficient by about +1.1, and acetylation decreases its partition coefficient by about −0.2. The numeral values described above are only examples. The amount of change by derivatization corresponds to a correction value, and the direction of change determines a positive or negative sign of the correction value. The correction value is registered in each record 32 when a compound is supposed to be derivatized or can be derivatized; otherwise the correction value is not registered in each record 32.

FIG. 4 illustrates a first example method for calculating a partition coefficient after derivatization based on the DB illustrated in FIG. 3. One or more compound identifying information items are input as search conditions 38. For a compound; that is, a record, satisfying the search condition 38, which is identified, a partition coefficient without derivatization or a partition coefficient before derivatization 40 associated with the compound is identified. When the search condition includes the derivatization type, the correction value 42 associated with the compound is referenced. The correction value 42 is added to the partition coefficient 40 without derivarization (see reference numeral 44); that is, the original partition coefficient is increased or decreased, to determine a partition coefficient that is a display value; that is, a partition coefficient after derivatization. When no derivatization is performed, correction using a correction value is not performed and the partition coefficient before derivatization is used as a display value. While the display value can be displayed as a numeral value, in the present embodiment, the display value is expressed as display coordinates of a sample marker on the coefficient axis. Specific expression forms will be described below with reference to each of FIG. 9 and the subsequent drawings. While the DB illustrated in FIG. 4 includes the correction value for each compound, the correction value that is a common numerical value may be shared by a plurality of compounds.

Figures 5, 6:
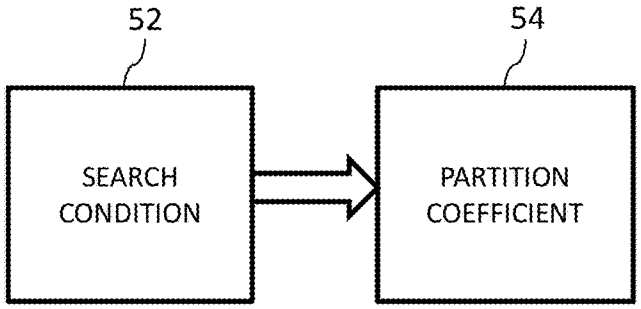
FIG. 5 is a diagram illustrating a second example ionization method selection assisting database.
FIG. 6 is a diagram illustrating a second example method of determining a partition coefficient after derivatization.

FIG. 5 illustrates a second example ionization method selection assisting DB. Similar to the first example described above, the DB in the second example includes a plurality of records 48 corresponding to a plurality of compounds. Each record 48 includes, as compound identifying information, the name of a compound, the composition formula, the structure, and the exact mass, for example. Each record 48 further includes a partition coefficient without derivatization, or a partition coefficient before derivatization, and a partition coefficient with derivatization, or a partition coefficient after derivatization. See reference numeral 50. In the second example, the partition coefficients after derivatization by themselves, not the correction values, are managed.

FIG. 6 illustrates a (second example) method of calculating the partition coefficient after derivatization based on the DB illustrated in FIG. 5. A compound that is a subject of mass spectroscopy is identified based on a search condition 52. A partition coefficient 54 is then specified for the compound based on the DB illustrated in FIG. 5. In this case, based on the information concerning presence or absence of derivatization and the type of derivatization, either a partition coefficient without derivatization or a partition coefficient after derivatization is specified. The information as to presence or absence derivatization and the type of derivatization forms the search condition.

Figures 7, 8:
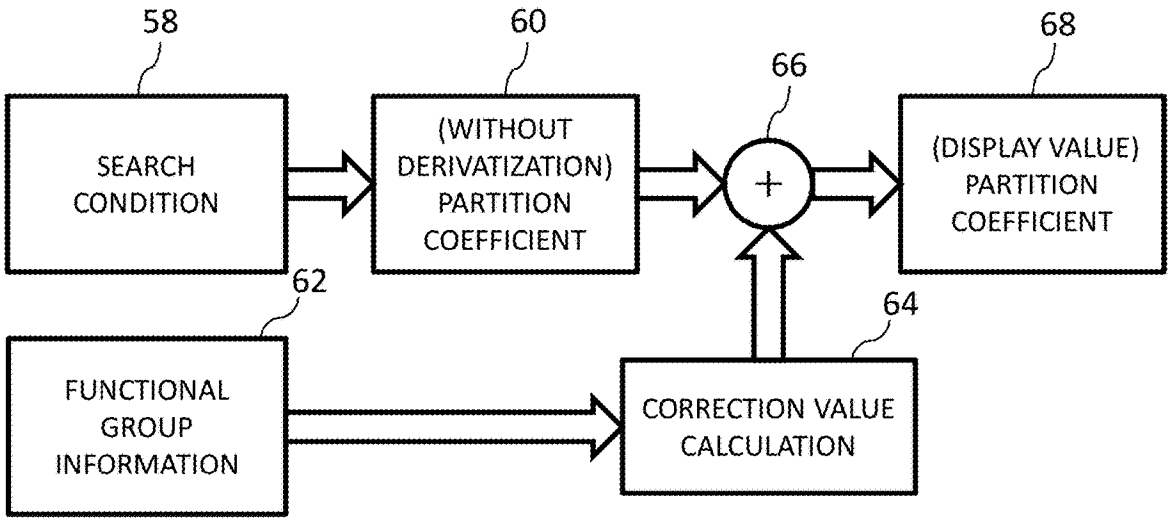
FIG. 7 is a diagram illustrating a third example ionization method selection assisting database.
FIG. 8 is a diagram illustrating a third example method of determining a partition coefficient after derivatization.

FIG. 7 illustrates a third example ionization method selection assisting DB. Similar to the first and second examples described above, the DB in the third example includes a plurality of records 56 corresponding to a plurality of compounds. Each record 56 includes, as compound identifying information, the name of a compound, the composition formula, and the structure, for example. Each record 56 further includes functional group information. Each record 56 also includes a partition coefficient without derivatization or a partition coefficient before derivatization. The functional group information represents information as to presence or absence of functional group, type of functional group, and the number of functional groups, for example, and forms a base of correction value calculation as will be described below. While, in the third example, the correction values and the partition coefficients after derivatization are not managed, these information items may be managed on the DB.

FIG. 8 illustrates a (third example) method of calculating a partition coefficient after derivatization based on the DB illustrated in FIG. 7. A compound that is a subject of mass spectroscopy is first identified based on a search condition 58. A partition coefficient 60 without derivatization for the compound is identified based on the DB illustrated in FIG. 7. Meanwhile, a correction value 64 is calculated based on functional group information 62 and the type of derivatization. More specifically, an amount of increase or decrease in the partition coefficient caused by derivatization is calculated as a correction value. The correction value is calculated based on the type and the number of functional groups of a compound and the type of derivatization, for example. Correction calculation 66 corrects the partition coefficient without derivatization based on the correction value 64, thereby determining a partition coefficient as a display value or a partition coefficient after derivatization.

The DB structures and the correction methods are described above only for illustrative purpose. In preferred embodiments, the DB is configured to enable determination of the partition coefficient for a compound to be analyzed based on various information items. Registration of the exact mass for each compound on the DB enables specification of a compound based on the mass; that is, an observed mass, obtained by previous-performed observation. In this case, a plurality of candidate compounds may be identified.

Referring now to FIGS. 9 to 14, the ionization method selection assisting image and the display image will be described.

Figure 9:
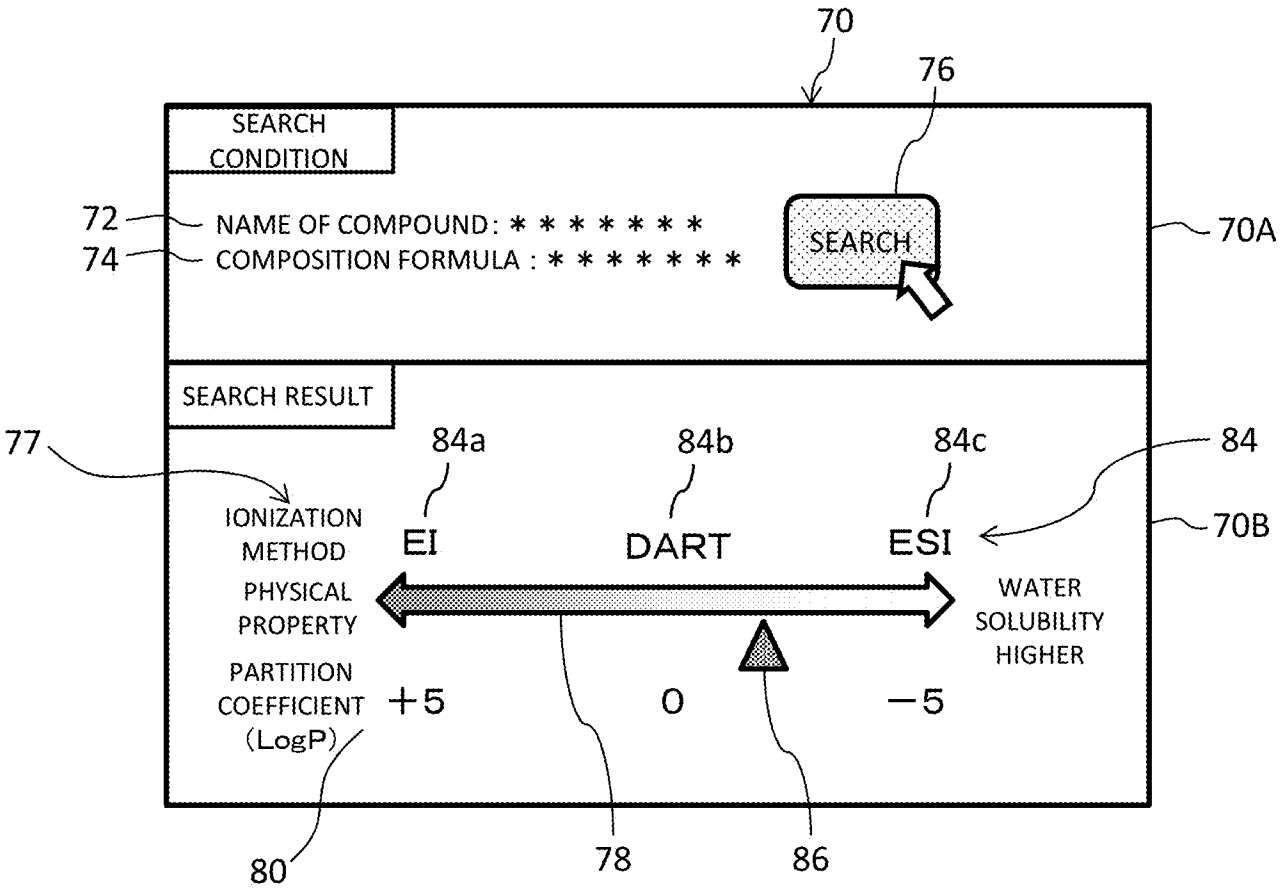
FIG. 9 is a diagram illustrating a first example display image including an ionization method selection assisting image.

FIG. 9 illustrates a first example display image including an ionization method selection assisting image according to a first embodiment. A display image 70, which constitutes a user interface, includes a search condition column 70A and a search result column 70B. A user inputs a search condition in the search condition column 70A. A user inputs, as the search condition, one or more compound identifying information items. For example, one or both of the name of compound 72, which is known, and the composition formula 74, which is known, are input. Operating or clicking a search button 76 starts search of DB, and automatically specifies a compound corresponding to the search condition and a partition coefficient of the compound.

The search result column 70B shows an ionization method selection assisting image 77 and compound information, as required. The compound information constitutes a record in the DB, and specifically includes the name of a compound, the composition formula, the structure, the exact mass, and other information.

The ionization method selection assisting image 77 in the illustrated first example includes a coefficient axis 78, a method indicator portion 84, and a sample marker 86, for example. The ionization method selection assisting image 77 includes an upper section, a middle section, and a lower section: the coefficient axis 78 is displayed in the middle section, the method indicator portion 84 is displayed in the upper section, and an index portion 80 is displayed in the lower section. The coefficient axis 78, which functions as a coordinate axis indicating the magnitude and polarity of the partition coefficient, is a horizontally extended graphic figure; that is, a display element. While in the illustrated example, the coefficient axis 78 includes arrows at both ends, it may include an arrow only at one end. The coefficient axis 78 may have any other form that functions as a coordinate axis. In the example illustrated in FIG. 9, the coefficient axis 78 indicates a positive side toward the left and a negative side toward the right. The ionization method selection assisting image 77 includes the index portion including numeral values "+5," "0," and "−5" in the illustrated example to indicate the polarity (positive or negative sign) and index of the partition coefficient, for example. The index portion 80 includes, at its left end, a character string "partition coefficient (Log P)" as a label.

The method indicator portion 84 in the illustrated example includes three character strings functioning as three display elements. Specifically, the method indicator portion 84 includes a method indicator 84*a* ("EI"), a method indicator 84*b* ("DRAT"), and a method indicator 84*c* ("ESI") displayed on the coefficient axis 78, all of which are identifiers for identifying corresponding ionization methods. In the illustrated example, the method indicator 84*a* is displayed near the edge toward the left; that is, the edge on the positive side, on the coefficient axis 78; the method indicator 84*b* is displayed in the middle position on the coefficient axis 78; and the method indicator 84*c* is displayed near the edge toward the right; that is, the edge on the negative side, on the coefficient axis 78.

This dispersed display of the method indicators 84*a*, 84*b*, and 84*c* on the coefficient axis 78 enables a user to visually recognize the coordinates; that is, a partition coefficient, or the range of coordinates; that is, a partition coefficient range approximately. Specifically, the illustrated display enables the user to recognize a rough trend that "EI" is suitable for samples with a relatively large partition coefficient, "ESI" is suitable for samples with a relatively large partition coefficient toward the negative direction, and "DART" is suitable for samples with different partition coefficients over a wide range from the negative side to the positive side. In other words, the illustrated display enables the user to spatially grasp the correlation among a plurality of ionization methods on the coefficient axis. The ionization method selection assisting image 77 further includes display of a character string "physical properties" representing the property of the coefficient axis on the left of the coefficient axis 78 and includes display of a character string "water solubility higher", which means that hydrophilicity is high, as a specific content of the physical properties on the right of the coefficient axis 78. A character string "liposolubility higher" or "hydrophobicity higher" may be displayed on the left of the coefficient axis 78.

The sample marker 86 is a display element that represents the partition coefficient of a sample. In the illustrated example, the sample marker 86 has a triangle figure and is displayed on the coefficient axis 78 at a position (coordinates) corresponding to the partition coefficient of a sample. Conversely, the user can grasp the rough magnitude of the partition coefficient of a sample from the position of the sample marker 86. Notably, the positional relationship between the sample marker and the three method indicators 84*a*, 84*b*, and 84*c* represents compatibility between the sample and the three ionization methods. The user can recognize that the ionization method closer to the sample marker 86 is more suitable for ionization of the sample and that the ionization method farther from the sample marker is less suitable for ionization of the sample.

The user can intuitively recognize, from the example illustrated in FIG. 9, that, for a sample that is currently a subject of measurement, DART is typically most suitable, ESI is second most suitable, and EI is not very suitable. The first example ionization method selection assisting image illustrated in FIG. 9 does not clearly show the upper or lower limit of the application range of each ionization method for each of the method indicator 84*a*, 84*b*, and 84*c*, and therefore provides only rough compatibility. Nevertheless, the illustrated ionization method selection assisting image can provide assisting information in accordance with a predetermined objective standard for selecting the ionization method for convenience of users. In particular, the illustrated image can provide useful information to users with poor experience and knowledge concerning mass spectroscopy, to compensate for the lack of knowledge and experience.

The coefficient axis 78 may have a form of a simple line or gradation, for example. Each method indicator 84*a*, 84*b*, or 84*c* may also have a display form other than a character string, that can identify the ionization method. The sample marker 86 may also have other forms that can indicate measurement coordinates or position. A multi-dimensional coordinate system defined by the coefficient axis 78 and one or more other axes may also be adopted.

Figure 10:
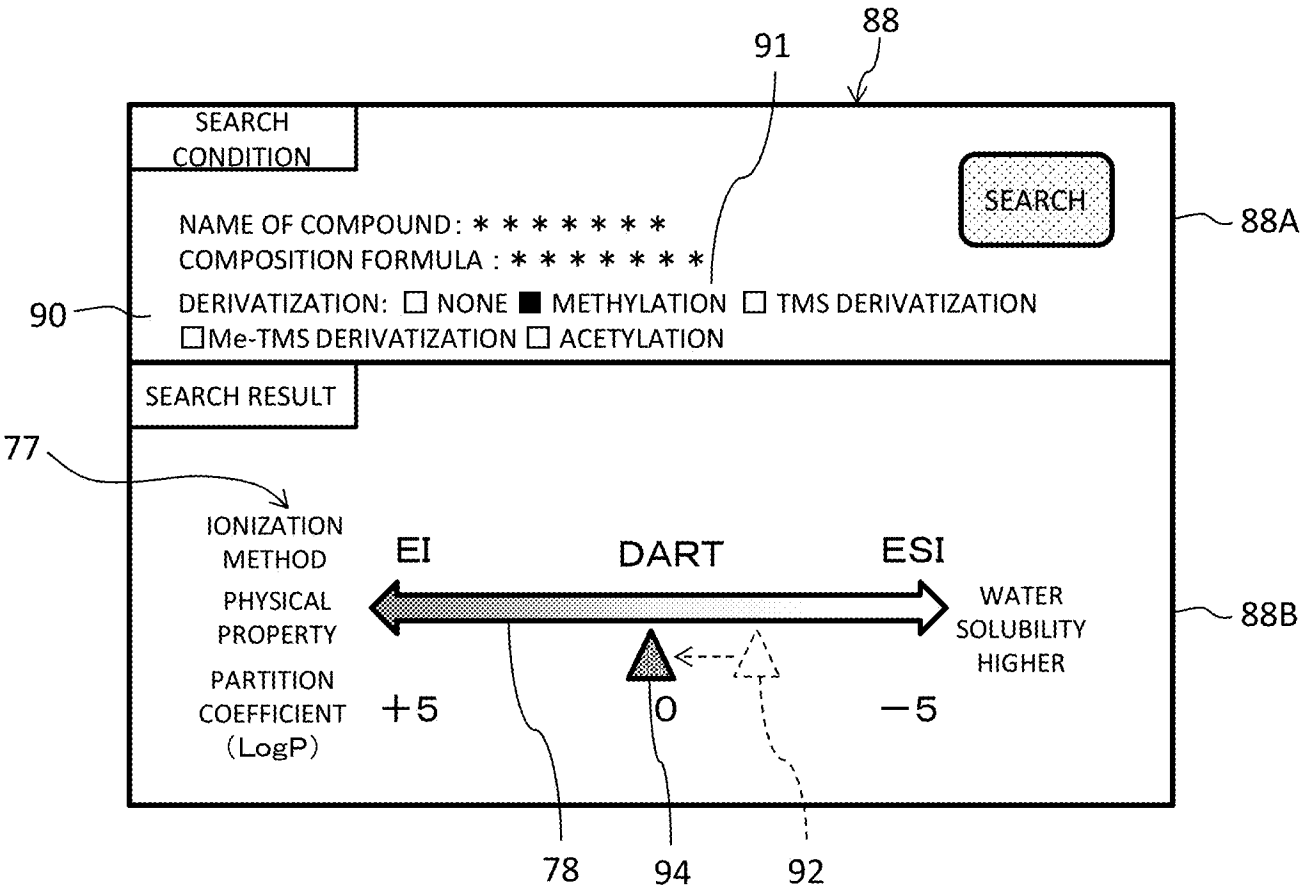
FIG. 10 is a diagram illustrating a second example display image including an ionization method selection assisting image.

FIG. 10 illustrates a second example display image including an ionization method selection assisting image. A display image 88 includes a search condition column 88A and a search result column 88B. A user inputs compound identifying information and designates presence or absence and type of derivatization in the search condition column 88A. Specifically, a line 90 for designating derivatization includes elements including "none," "methylation," "TMS derivatization" representing trimethylsilylation, "Me-TMS derivatization" representing Me-trimethylsilylation, and "acetylation." In the illustrated example, the user designates "methylation" as indicated by reference numeral 91. In this second example, after specification of a compound based on one or more compound identifying information items, a partition coefficient after derivatization or a partition coefficient of a derivatized compound is specified. The ionization method selection assisting image 77 includes the coefficient axis 78 and a sample marker 94 indicating the partition coefficient after derivatization. The sample marker 94 indicating the partition coefficient after derivatization may be displayed after a sample marker 92 indicating a partition coefficient before derivatization is displayed, or these sample markers 92 and 94 may be displayed simultaneously. This structure enables the user to recognize in which direction and to what degree the partition coefficient would change after specific derivatization and to also grasp how presence or absence of derivatization would change compatibility between the sample and each ionization method. The user can therefore acquire information for determining whether or not derivatization should be performed and which derivatization type should be performed.

Figure 11:
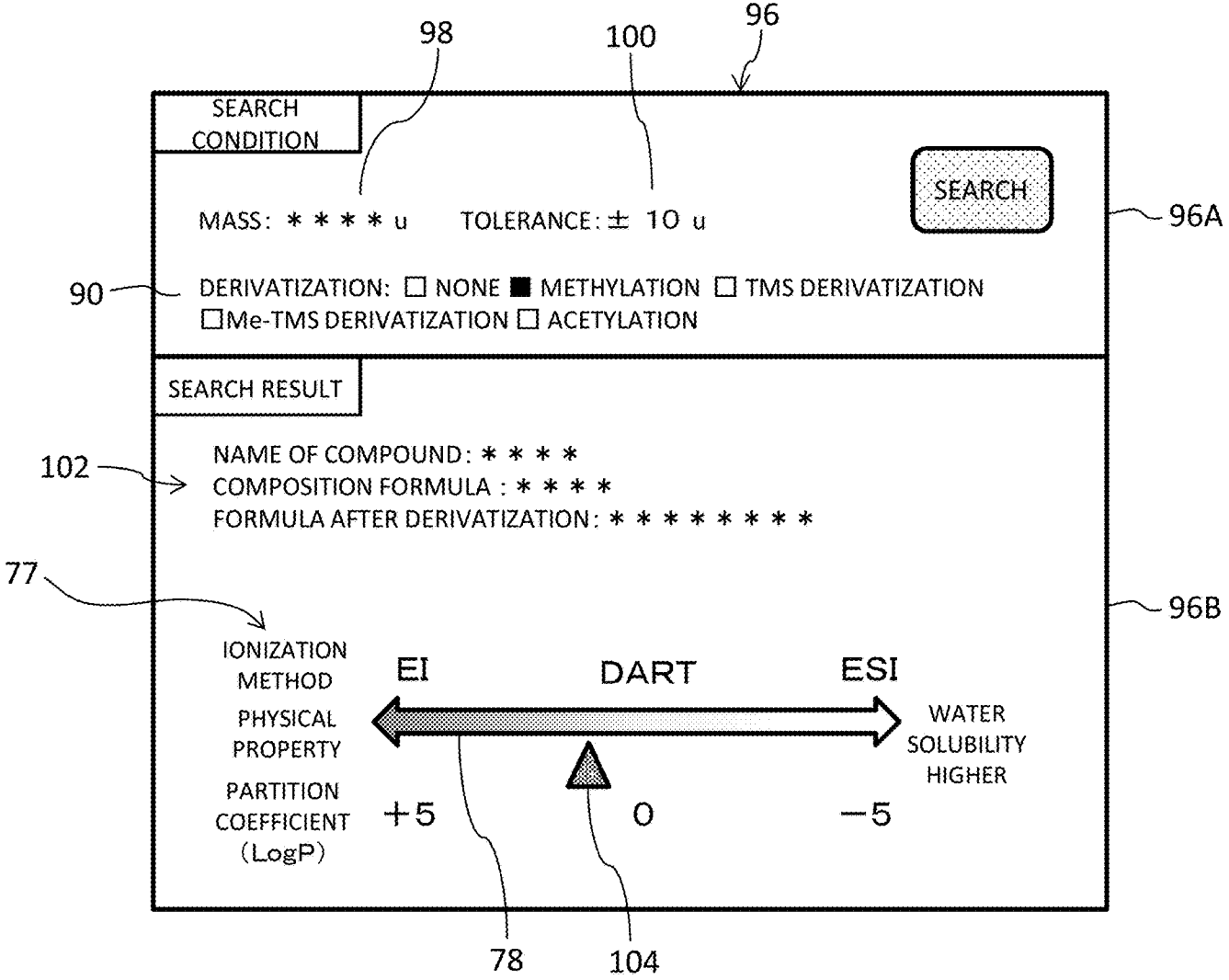
FIG. 11 is a diagram illustrating a third example display image including an ionization method selection assisting image.

FIG. 11 illustrates a third example display image including an ionization method selection assisting image. A display image 96 includes a search condition column 96A and a search result column 96B. The user inputs a mass 98 as one type compound identifying information item and an allowable range as a tolerance 100 in the search condition column 96A. The mass 98 to be input is a mass that is observed by preliminary mass spectroscopy; that is an observed mass. In compound search, the input mass 98 is compared with a plurality of exact masses registered in the DB. When a difference between the input mass and an exact mass falls within the allowable range, they are regarded to match, and one or more compounds that are regarded to match are identified as search results.

In the example illustrated in FIG. 11, designation of presence or absence and type of derivatization by the line 90 is not essential. When derivatization is designated, a partition coefficient that is expected when the compound identified by search is derivatized is specified. The search result column 96B displays compound information 102 concerning the compound identified by search. The illustrated example shows the name of the compound, the composition formula, and the composition formula after derivatization of the compound. On the coefficient axis 78, a partition coefficient of the identified compound after derivatization is displayed as a sample marker 104. The third example display image enables the user to perform compound search based on the observed mass concerning an unknown compound.

Figure 12:
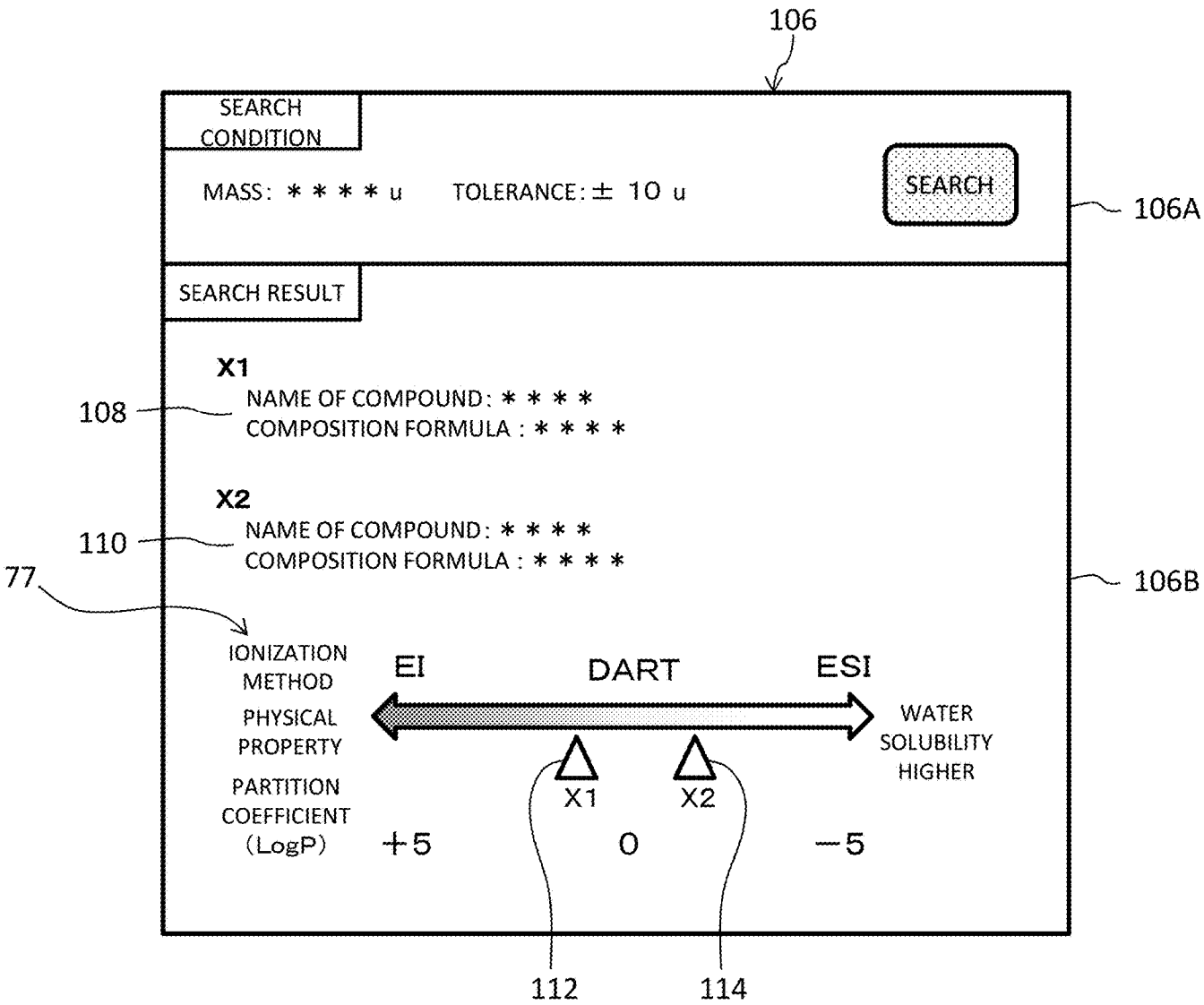
FIG. 12 is a diagram illustrating a fourth example display image including an ionization method selection assisting image.

FIG. 12 illustrates a fourth example display image including an ionization method selection assisting image. A display image 106 includes a search condition column 106A and a search result column 106B. The user inputs a mass and tolerance or an allowable range in the search condition column 106A. Based on the information, search for a sample compound which is a subject of mass spectroscopy is performed. In the illustrated example, the search result column 106B shows two hit compounds and two compound information items 108 and 110 for the two compounds. In the illustrated example, each compound information item 108 or 110 includes the name of the compound and the composition formula. The compound information item may further include an exact mass, for example.

The search result column 106B displays the ionization method selection assisting image 77 according to the first embodiment illustrated in FIGS. 9 to 11. The search result column 106B, however, displays two sample markers 112 and 114 corresponding to the search results of two compounds. The two sample markers 112 and 114 indicate two partition coefficients specified for the two compounds, respectively. Labels X1 and X2 indicating correspondence with the two compound information items 108 and 110, respectively, are displayed near the corresponding sample markers 112 and 114. Three or more sample markers may be displayed. The user can adjust search precision, for example, by varying numeral values input as the tolerance. A difference between the input mass and the exact mass, or reliability evaluation values indicating the degree of the difference may be displayed.

Figure 13:
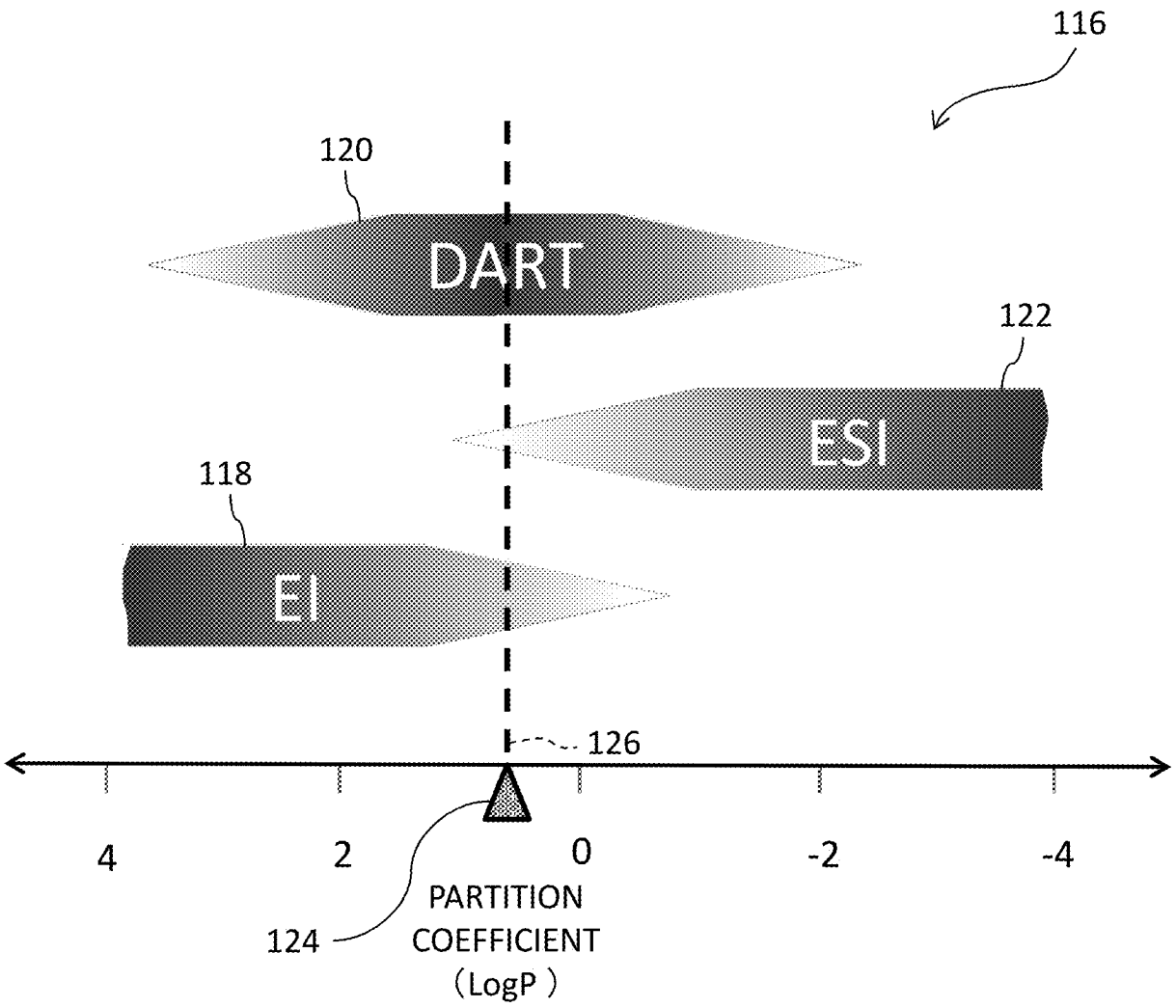
FIG. 13 is a diagram illustrating an ionization method selection assisting image according to a second embodiment.

FIG. 13 illustrates an ionization method selection assisting image according to a second embodiment. The second embodiment, similar to the first embodiment described above, has a one-dimensional coordinate system.

Referring to FIG. 13, the horizontal axis is a coefficient axis indicating the magnitude of a partition coefficient. The ionization method selection assisting image shows, above the coefficient axis, a plurality of method indicators 118, 120, and 122 dispersed in the vertical direction to avoid overlapping of these indicators. The vertical axis is provided only for the purpose of avoiding such overlapping. The plurality of method indicators 118, 120, and 122 are shown as horizontally elongated figures representing the ionization methods EI, DART, and ESI, respectively. More specifically, a method indicator 118 shows an approximate range of the partition coefficient suitable for EI on the coefficient axis. A method indicator 120 shows an approximate range of the partition coefficient suitable for DART on the coefficient axis. A method indicator 122 shows an approximate range of the partition coefficient suitable for ESI on the coefficient axis. The illustrated allocation is only for explanation of the disclosure and the range of partition coefficient suitable for each ionization method is actually defined by experiments and calculations, for example.

The width of each method indicator 118, 120, or 122 in the vertical direction gradually decreases toward one or both ends: that is, each method indicator 118, 120, or 122 has one or both ends that are tapered. The width of each method indicator 118, 120, or 122 in the vertical direction at each location represents the degree of compatibility or recommendation that can be understood as intensity or sensitivity. The ionization method selection assisting image further includes a sample marker 124 near the coefficient axis. The sample marker 124 represents a partition coefficient specified for the compound which is a subject of measurement. The ionization method selection assisting image also shows, along with the sample marker 124, a vertical line 126 indicating the partition coefficient. The vertical line 126 crosses the method indicators 118, 120, and 122 with different crossing lengths among the indicators. The user can recognize that in the illustrated example, DART representing the method indicator 120 with the largest crossing length is the first choice among the ionization methods.

In the second embodiment described above, two sample markers indicating the partition coefficient before derivatization and the partition coefficient after derivatization, respectively, may be displayed. A change of the partition coefficient caused by derivatization may be displayed as a shift of the sample marker. More specifically, a sliding movement of the sample marker from the coordinates corresponding to the partition coefficient before derivatization to the coordinates corresponding to the partition coefficient after derivatization may be displayed as amination. A plurality of method indicators having vertically elongated figures may be displayed with the coefficient axis which is a vertical axis.

Figure 14:
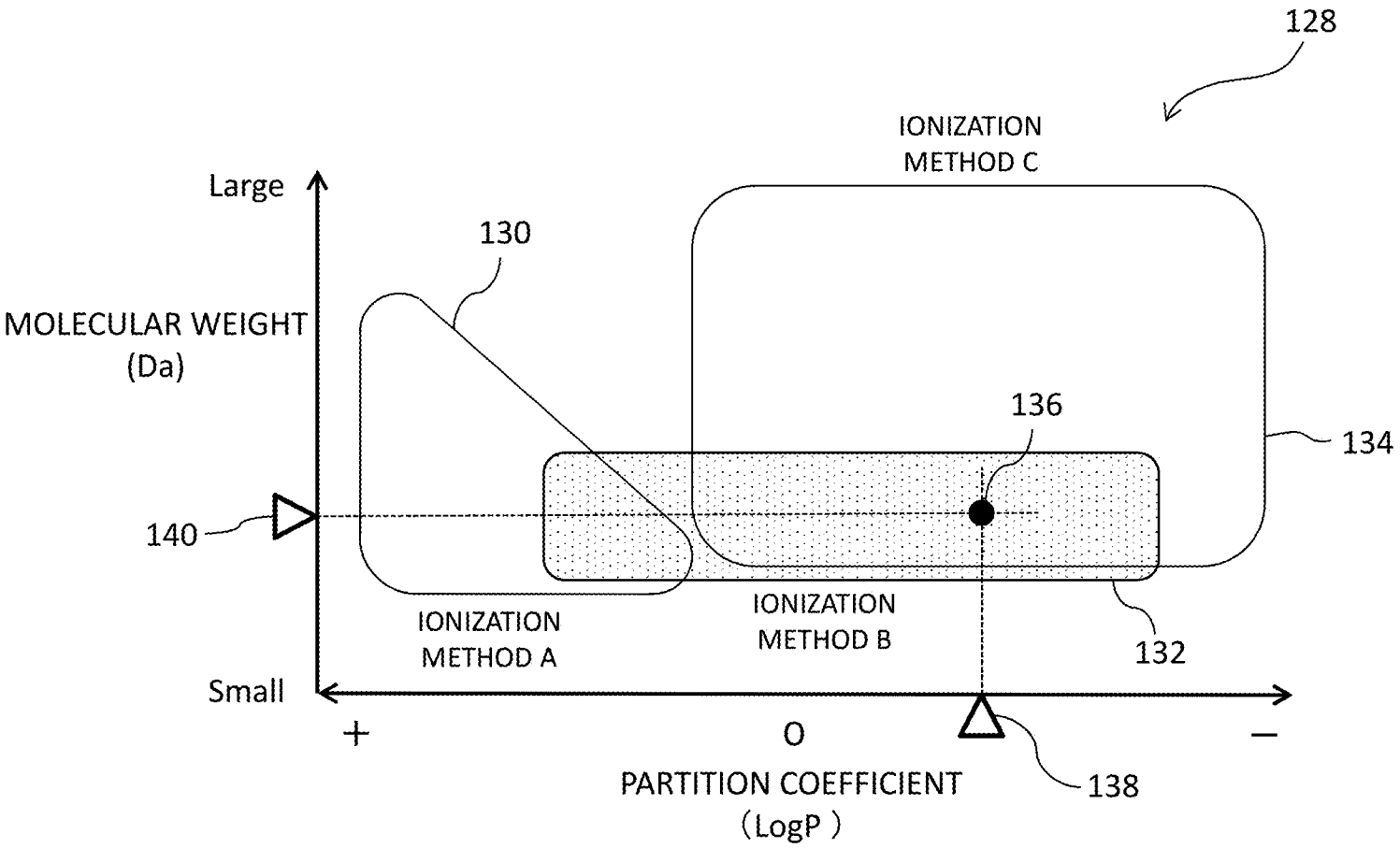
FIG. 14 is a diagram illustrating an ionization method selection assisting image according to a third embodiment.

FIG. 14 illustrates an ionization method selection assisting image according to a third embodiment having a two-dimensional coordinate system.

Referring to FIG. 14, the horizontal axis is a coefficient axis indicating the magnitude of a partition coefficient, and the vertical axis indicates the magnitude of molecular weight of a compound or a sample. A plurality of method indicators 130, 132, and 134 are expressed in the form of figures on a two-dimensional coordinate system defined by the horizontal and vertical axes. FIG. 14 illustrates the individual figures at example locations and in example shapes and sizes. Each method indicator 130, 132, or 134 shows a two-dimensional coordinate range suitable for each ionization method A, B, or C. The two-dimensional coordinates are specified by the partition coefficient and the molecular weight. When the partition coefficient and the molecular weight are specified for a sample which is a subject of mass spectroscopy, a main sample marker 136 is displayed on the two-dimensional coordinates specified by the partition coefficient and the molecular weight. A first sub sample marker 138 indicates the partition coefficient of the sample, and a second sub sample marker 140 indicates the molecular weight of the sample. By specifying one or more method indicators to which a sample marker 136 belongs, the user can recognize one or more ionization methods suitable for the sample. The coordinates, shape, and size, for example, of each figure representing each ionization method can be determined by experiments, calculations, and other methods.

In the third embodiment, when the partition coefficient of a certain sample is specified but the molecular weight of the sample is unknown, only the first sub sample marker 138 is displayed. The ionization method selection assisting image according to the third embodiment sufficiently works even in such a situation. Specifically, the ionization method selection assisting image according to the third embodiment enables the user to recognize one or more possible suitable ionization methods in association with the molecular weight. When an approximate molecular weight or the trend of the molecular weight concerning the sample is known, the user can narrow down the ionization methods from the ionization method selection assisting image according to the third embodiment.

In the third embodiment described above, the partition coefficients before and after derivatization may be expressed with two main sample markers or may be expressed as a movement of the main sample marker. Derivatization increases or decreases the partition coefficient and also increases the molecular weight. For example, methylation increases the molecular weight by 14 Da, trimethylsilylation (TMS) increases the molecular weight by 72 Da, and acetylation increases the molecular weight by 42 Da. Physical properties other than the molecular weight may be assigned on the vertical axis. Three or more dimensional coordinate system may also be configured.

A polarity, a physical property that is ambiguous and difficult to express numerically, has been used as a criterion in selecting an ionization method suitable to a sample. The embodiments described above use a partition coefficient, a physical property that is objective and easy to express numerically, as a criterion to enable determination of compatibility between a sample and each ionization method based on the partition coefficient of the sample. In the above embodiments, the partition coefficient may be Log D rather than Log P, and other coefficients (coefficients representing the degree of hydrophilicity or hydrophobicity) that are equivalent to the partition coefficient may be used in place of the partition coefficient.

In a modification example, ionization method selection assisting information other than the ionization method selection assisting image including a counting axis and a sample marker may be provided to a user. For example, a system may generate, based on the partition coefficient of a sample that is a subject of mass spectroscopy, text information and figure information expressing one or more ionization methods suitable for the sample and provide the information to a user. In this example, the range of the partition coefficient or a median of the partition coefficient may be managed for each ionization method. Alternatively, a system may evaluate compatibility for each ionization method and display a score indicating an evaluation result.

The ionization method selection assisting image according to the embodiments described above spatially expresses compatibility between a sample and each ionization method based on an understandable coordinate system, to enable the user to intuitively recognize the compatibility. The above embodiments further enable the user to understand that, to perform mass spectroscopy with high sensitivity by DART concerning a sample with high water solubility or a sample with low Log P value, derivatization directed at liposolubility (methylation, trimethylsilylation, for example) can be performed for the sample. In other words, adapting the properties of a sample to a specific ionization method, particularly, DART, makes the most of advantages of the specified ionization method.

The invention claimed is:

1. An ionization method selection assisting apparatus comprising:

an input unit configured to receive a search condition about a sample that is a subject of mass spectroscopy;

a specifying unit including:

a database including a plurality of records corresponding to a plurality of compounds that are possible samples, each of the plurality of records including a coefficient representing a degree of water solubility; and a search unit configured to automatically specify to a user a coefficient for the sample by searching the database and identify the coefficient in accordance with the search condition;

a generating unit configured to generate an ionization method selection assisting image including a coefficient axis associated with a plurality of ionization methods, a plurality of method indicators corresponding to the plurality of ionization methods, each of the plurality of method indicators being associated with coordinates or a coordinate range on the coefficient axis, and a sample marker indicating the specified coefficient; and a display unit configured to display the ionization method selection assisting image.

2. The ionization method selection assisting apparatus according to claim 1, wherein the coefficient representing water solubility is a partition coefficient.

3. The ionization method selection assisting apparatus according to claim 1, wherein the plurality of records include a record for a compound that can be derivatized, and the record for the compound that can be derivatized includes information for specifying a coefficient before derivatization and a coefficient after derivatization.

4. The ionization method selection assisting apparatus according to claim 3, wherein the record for a compound that can be derivatized includes the coefficient before derivatization and a correction value used for determining the coefficient after derivatization from the coefficient before derivatization, and the specifying unit includes a correcting unit configured to correct the coefficient before derivatization with the correction value to calculate the coefficient after derivatization.

5. The ionization method selection assisting apparatus according to claim 3, wherein the record for a compound that can be derivatized includes the coefficient before derivatization and the coefficient after derivatization.

6. The ionization method selection assisting apparatus according to claim 3, wherein the record for a compound that can be derivatized includes the coefficient before derivatization and functional group information, and the specifying unit includes a correcting unit configured to correct the coefficient before derivatization with a correction value based on the functional group information to calculate the coefficient after derivatization.

7. The ionization method selection assisting apparatus according to claim 3, wherein each of the records includes at least one of a name of a compound, a composition formula, a structure, or an exact mass.

8. The ionization method selection assisting apparatus according to claim 1, wherein the ionization method selection assisting image includes a first axis serving as the coefficient axis and a second axis orthogonal to the first axis, the second axis representing a physical property other than the coefficient, the sample marker is displayed at a position in accordance with coordinates on the first axis corresponding to the coefficient and coordinates on the second axis corresponding to the physical property of the sample other than the coefficient.

9. A mass spectrometer system, comprising:

an ionization method selection assisting apparatus; and a mass spectrometer configured to incorporate an ion source selected by a user, wherein the ionization method selection assisting apparatus includes:

an input unit configured to receive a search condition about a sample that is a subject of mass spectroscopy;

a specifying unit including:

a database including a plurality of records corresponding to a plurality of compounds that are possible samples, each of the plurality of records including a coefficient representing a degree of water solubility; and a search unit configured to automatically specify to a user a coefficient for the sample by searching the database and identify the coefficient in accordance with the search condition;

a generating unit configured to generate an ionization method selection assisting image including a coefficient axis associated with a plurality of ionization methods, a plurality of method indicators corresponding to the plurality of ionization methods, each of the plurality of method indicators being associated with coordinates or a coordinate range on the coefficient axis, and a sample marker representing the specified coefficient; and a display unit configured to display the ionization method selection assisting image to the user.

* * * * *